US005158053A

United States Patent [19]

Krechberger et al.

[11] Patent Number: 5,158,053

[45] Date of Patent: Oct. 27, 1992

[54] OIL PAN FOR AN INTERNAL-COMBUSTION ENGINE

[75] Inventors: Wolfgang Krechberger, Ditzingen; Rudolf Herrmann, Wimsheim; Sebastian Pape, Wiernsheim, all of Fed. Rep. of Germany

[73] Assignee: Dr. Ing. h.c.F. Porsche AG, Fed. Rep. of Germany

[21] Appl. No.: 694,550

[22] Filed: May 2, 1991

[30] Foreign Application Priority Data

May 9, 1990 [DE] Fed. Rep. of Germany ..... 4014788

[51] Int. Cl.[5] ..... F02F 7/00; F02B 77/13; F01M 11/00

[52] U.S. Cl. ..... 123/195 C; 123/196 R; 184/106

[58] Field of Search ..... 123/195 C, 196 R; 184/6.5, 106

[56] References Cited

U.S. PATENT DOCUMENTS 4,101,003 7/1978 Timour et al. ..... 184/106
4,388,899 6/1983 Shimada et al. ..... 123/195 C
4,848,293 7/1989 Sasada et al. ..... 123/195 C
4,911,118 3/1990 Kageyama et al. ..... 123/195 C

FOREIGN PATENT DOCUMENTS 0149313 7/1985 European Pat. Off. .
3444838 6/1986 Fed. Rep. of Germany .
3520176 1/1987 Fed. Rep. of Germany .
3806105 10/1988 Fed. Rep. of Germany .
3731734 4/1989 Fed. Rep. of Germany .
4014788 3/1991 Fed. Rep. of Germany .
57-102540 6/1982 Japan .
2074645 11/1981 United Kingdom .

*Primary Examiner*—E. Rollins Cross
*Assistant Examiner*—Erick Solis
*Attorney, Agent, or Firm*—Evenson, Wands, Edwards, Lenahan & McKeown

[57] ABSTRACT

An oil pan held on a crankcase of an internal-combustion engine has a flat, plate-type bottom and an oil sump. The flat bottom is connected by means of supports directly to central bearing seats of the crankshaft. This significantly improves the sound radiation of the oil pan and the rigidity of the bearing seats.

20 Claims, 2 Drawing Sheets

OIL PAN FOR AN INTERNAL-COMBUSTION ENGINE

BACKGROUND AND SUMMARY OF THE INVENTION

The invention relates to an oil pan for a multi-cylinder internal-combustion engine of the type having a horizontally divided crankcase which has a crankshaft held in bearing seats, the oil pan being disposed on the bottom half of the crankcase.

Crankcases and oil pans of internal-combustion engines which are arranged on the crankcases tend to perform vibrations during the operation which cause undesirable sounds. Particularly in the case of internal-combustion engines which have relatively long dimensions and have an oil pan that extends in a relatively flat and plate-shaped manner, the acoustic behavior is unsatisfactory.

From the German Patent Document DE 35 20 176, it is known that, in order to achieve a high bending strength and torsional rigidity of a crankcase, an oil pan is screwed to its flange, the corresponding flange being constructed as a rigid frame with a U-shaped cross-section. This frame has transverse webs which may be screwed to bearing seats of the crankshaft, in which case the accessibility of this screwed connection appears to present a serious problem. In this case, the oil pan itself extends away from this frame in a U-shaped manner. The crankshaft bearing is situated completely inside the crankcase; that is, the junction between the crankcase and the oil pan is situated below the crankshaft.

The German Patent Document DE 38 06 105 discloses a divided crankcase bottom half, the semicircular exterior part of which is screwed to the crankcase top part which has only the cylinder bores and in which an interior part is arranged which receives the crankshaft and the bearing seats of which are supported on the crankcase top half and the exterior part by means of radially arranged struts.

Solutions of this type cannot be used in the case of internal-combustion engines having a crankcase which, at the level of the longitudinal axis of the crankshaft, is horizontally separated into a top half and a bottom half and a separate oil pan is connected with the bottom half, as known from the German Patent Document DE 34 44 838 which relates to this type.

It is an object of the invention to reduce the sound radiation of noise from an oil pan by simple devices.

This object is achieved by providing an arrangement of the above-noted type, including an essentially flat extending bottom, and connecting means for accommodating detachable holding of the oil pan to the bottom half of the crankcase in a connecting plane, wherein the connecting means includes means for detachably connecting with the bearing seats.

The connection of the flat part of the oil pan to bearing seats which are disposed above it and receive the crankshaft clearly reduces the sound radiation from the oil pan and shifts the excited frequencies upward into a range which subjectively is felt to be less annoying.

Advantageously, additional longitudinal vibrations, particularly of central bearing seats, which occur in the operation of the internal-combustion engine, are effectively eliminated.

In certain preferred embodiments, the sound radiation is essentially reduced by the fact that the bottom of the oil pan, which extends in a flat and plate-shaped manner, is connected to the bearing seats in the area of center bearing seats, that is, in the area of the highest vibration amplitude of the bottom. The original large-surface bottom, with respect to the sound radiation, is therefore separated into several smaller partial areas which vibrate at a higher frequency with less amplitude. The longitudinal vibrations of the bearing seats are eliminated by the rigid connection to the bottom of the oil pan by means of the supports. The supports are advantageously arranged transversely to the longitudinal direction of the internal-combustion engine in parallel planes which also receive the bearing seats. A U-shaped design of the supports, in which the parallel legs are constructed in one piece with the oil pan as tubes receiving screws, permits a simple manufacturing of the pan which is advantageous with respect to production. The oil pan receives additional stability by means of ribs arranged between adjacent supports on the bottom of the oil pan which are at the same time used as oil deflectors for the lubricating oil thrown off by the crankdrive and for this purpose may be set against the rotating direction of the crankshaft. The stability is further increased by a diagonal arrangement of these ribs between adjacent supports. The screws, which penetrate the tubes and are connected with the bearing seats are accessible for servicing at any time.

Other objects, advantages and novel features of the present invention will become apparent from the following detailed description of the invention when considered in conjunction with the accompanying drawings.

DETAILED DESCRIPTION OF THE DRAWINGS

Figure 1:
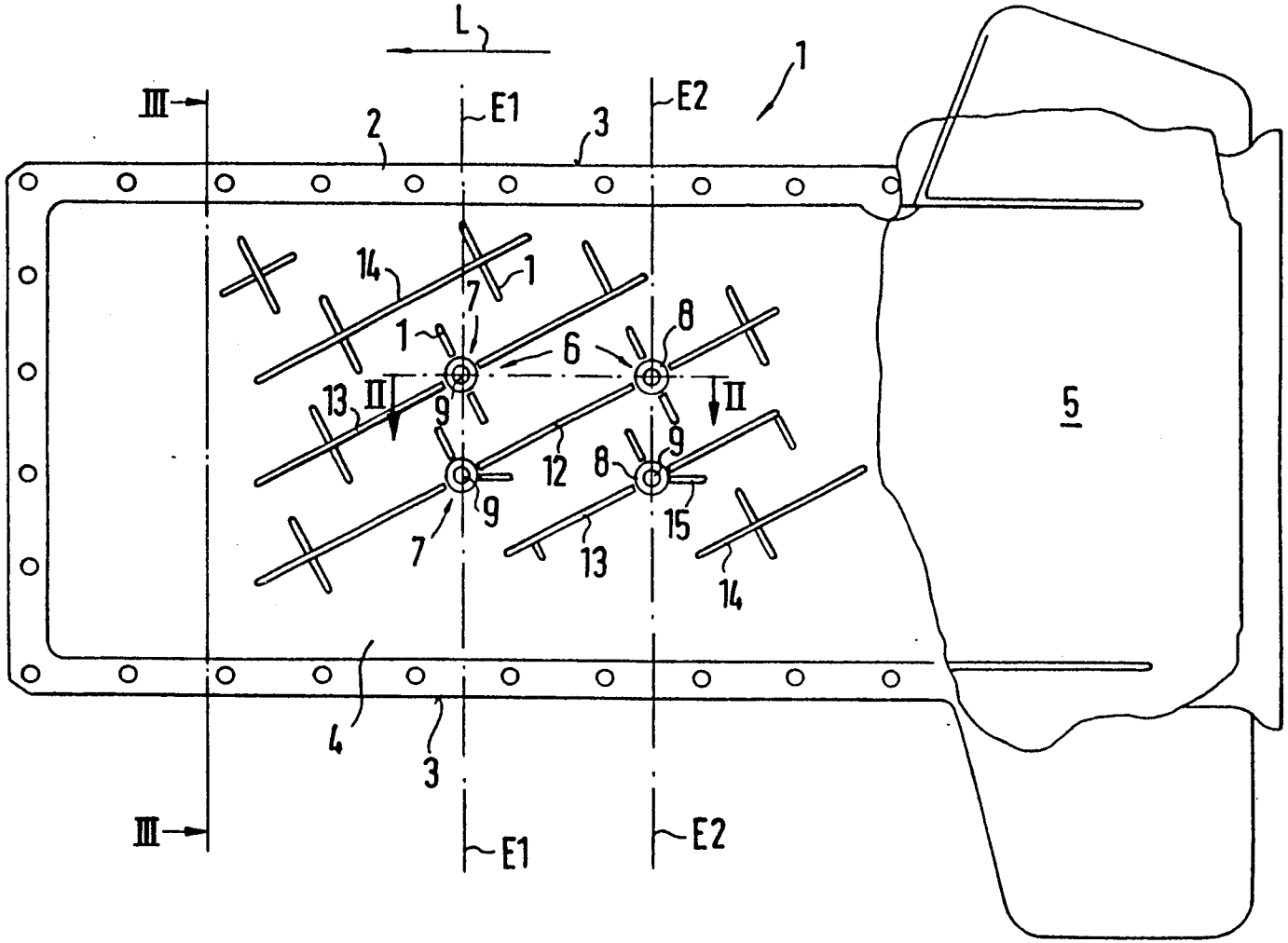
FIG. 1 is a top view of an oil pan constructed according to a preferred embodiment of the invention.
Figure 2:
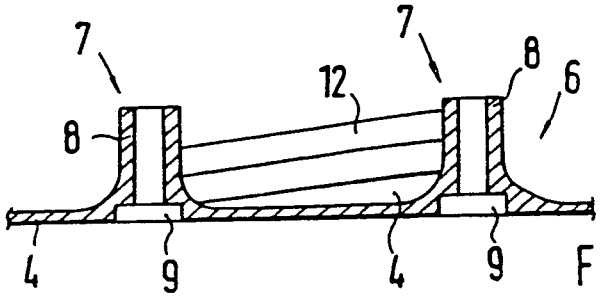
FIG. 2 is an enlarged sectional view along Line II—II of FIG. 1.
Figure 3:
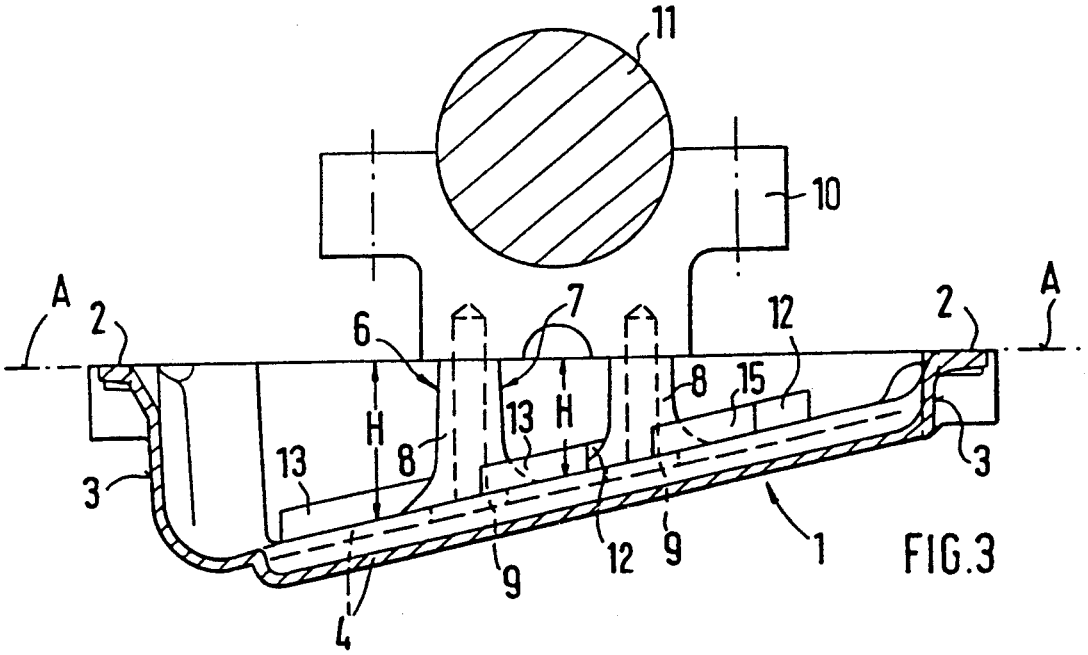
FIG. 3 is an enlarged sectional view along Line III—III of FIG. 1.

An oil pan I of a multi-cylinder internal-combustion engine, which is not shown, has a flange 2 situated in a connecting plane A by means of which the oil pan 1 is detachably held on a horizontally divided crankcase of the internal-combustion engine which is also not shown. The oil pan 1 is laterally bounded by walls 3 extending in the longitudinal direction L of the internal-combustion engine and a plate-type flat bottom 4 extending between the walls which is inclined with respect to the plane A. At one end of the oil pan 1 the bottom 4 merges over into the deep part constructed as the oil sump 5.

In parallel planes E1, E2, which extend transversely with respect to the longitudinal direction L, supports 6 are arranged which extend vertically (perpendicularly) with respect to the connecting plane A from the bottom 4 to this plane A. These supports have a U-shaped design, the two parallel legs 7 being constructed as tubes 8. The tubes 8 have ducts 9 by which the bottom 4, by means of screws which are not shown, is screwed to bearing seats 10 of the crankshaft 11, the bearing seats 10 being bounded by the connecting plane A so that the distance H between the bottom 4 and the plane A is bridged by the tubes 8.

One tube 8 of one support 6 respectively is connected, by way of a rib 12 constructed in one piece with the bottom 4, to a diagonally opposite tube 8 of an adjacent support 6. Ribs 13, which are arranged adjacent to the rib 12, receive one tube 8 respectively. Outside the supports 6, additional ribs 14 are arranged on the bottom.

The stability of the oil pan 1 is further increased by short supporting ribs 15 which extend transversely to the ribs 12, 13, 14 and the tubes 8.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An oil pan for a multi-cylinder internal-combustion engine of the type having a horizontally divided crankcase which has a crankshaft held in bearing seats, the oil pan being disposed on the bottom half of the crankcase, said oil pan comprising:

a pan bottom, pan walls extending upwardly from the pan bottom to define an oil accommodating space together with the pan bottom, and a plurality of supports extending upwardly from the pan bottom toward the bearing seats and including respective openings for accommodating detachable connectors for detachably connecting the pan bottom to the bearing seats, wherein said supports each include stabilizing ribs extending along the pan bottom away from the respective openings, said stabilizing ribs being spaced from the pan walls; and wherein the supports are constructed in one piece with the oil pan bottom and extend vertically with respect to a connecting plane containing the top of the pan walls from the bottom to this connecting plane.

2. An oil pan according to claim 1, wherein two of said openings are connected with one another by a common stabilizing rib which protrudes upwardly from the pan bottom.

3. An oil pan according to claim 1, wherein said supports are formed integrally with the pan bottom.

4. An oil pan according to claim 1, wherein the supports each define a connecting tube with a respective one of the openings therethrough, and wherein the top of each of the connecting tubes abuts directly with an engine bearing seat when in an installed condition on a vehicle engine.

5. An oil pan according to claim 4, wherein said supports are formed integrally with the pan bottom.

6. An oil pan according to claim 4, wherein the tops of the connecting tubes are in a common connecting plane with tops of the pan walls when in an installed position on a vehicle engine.

7. An oil pan according to claim 1, wherein a plurality of said supports are provided extending in respective parallel planes and transversely with respect to the longitudinal direction of the internal-combustion engine.

8. An oil pan according to claim 7, wherein the supports have a U-shaped design, two parallel legs of the U-shaped design being constructed as tubes which each include a respective one of the openings, which openings are configured for receiving screws for connecting with threaded openings in the bearing seats.

9. An oil pan according to claim 3, wherein the supports are constructed in one piece with the oil pan bottom and extend vertically with respect to a connecting plane containing the top of the pan walls from the bottom to this connecting plane.

10. An oil pan according to claim 4, wherein the supports are constructed in one piece with the oil pan bottom and extend vertically with respect to a connecting plane containing the top of the pan walls from the bottom to this connecting plane.

11. An oil pan according to claim 8, wherein at least one tube of each support is connected by means of a rib with a tube of an adjacent support.

12. An oil pan according to claim 10, wherein at least one tube of each support is connected by means of a rib with a tube of an adjacent support.

13. An oil pan according to claim 11, wherein additional ribs are arranged in parallel to the rib outside of the supports.

14. An oil pan according to claim 12, wherein additional ribs are arranged in parallel to the rib outside of the supports.

15. An oil pan according to claim 8, wherein reinforcing ribs are arranged outside of the supports and integral with the oil pan bottom.

16. An oil pan according to claim 1, wherein reinforcing ribs are arranged outside of the supports and integral with the oil pan bottom.

17. An oil pan according to claim 10, wherein reinforcing ribs are arranged outside of the supports and integral with the oil pan bottom.

18. An oil pan for a multi-cylinder internal-combustion engine of the type having a horizontally divided crankcase which has a crankshaft held in bearing seats, the oil pan being disposed on the bottom half of the crankcase, said oil pan comprising:

a pan bottom, pan walls extending upwardly from the pan bottom to define an oil accommodating space together with the pan bottom, and a plurality of supports extending upwardly from the pan bottom toward the bearing seats and including respective openings for accommodating detachable connectors for detachably connecting the pan bottom to the bearing seats, wherein said supports each include stabilizing ribs extending along the pan bottom away from the respective openings, said stabilizing ribs being spaced from the pan walls; and wherein the stabilizing ribs are configured to serve as oil deflectors for guiding oil into an oil sump.

19. An oil pan for a multi-cylinder internal-combustion engine of the type having a horizontally divided crankcase which has a crankshaft held in bearing seats, the oil pan being disposed on the bottom half of the crankcase, said oil pan comprising:

a pan bottom, pan walls extending upwardly from the pan bottom to define an oil accommodating space together with the pan bottom, and a plurality of supports extending upwardly from the pan bottom toward the bearing seats and including respective openings for accommodating detachable connectors for detachably connecting the pan bottom to the bearing seats, wherein the tops of the supports are in a common connecting plane with tops of the pan walls when in an installed position on a vehicle engine.

20. An oil pan according to claim 19, wherein the supports each define a connecting tube with a respective one of the openings therethrough, and wherein the top of each of the connecting tubes abuts directly with an engine bearing seat when in an installed condition on a vehicle engine.

* * * * *